US008769867B2

(12) United States Patent
Parsheh et al.

(10) Patent No.: US 8,769,867 B2
(45) Date of Patent: Jul. 8, 2014

(54) SYSTEMS, METHODS, AND MEDIA FOR CIRCULATING FLUID IN AN ALGAE CULTIVATION POND

(75) Inventors: Mehran Parsheh, Hayward, CA (US); Jordan Smith, Sacramento, CA (US); Stephen Strutner, San Jose, CA (US); Guido Radaelli, Oakland, CA (US)

(73) Assignee: Aurora Algae, Inc., Hayward, CA (US)

( * ) Notice: Subject to any disclaimer, the term of this patent is extended or adjusted under 35 U.S.C. 154(b) by 0 days.

(21) Appl. No.: 12/485,862

(22) Filed: Jun. 16, 2009

(65) Prior Publication Data

US 2010/0260618 A1 Oct. 14, 2010

(51) Int. Cl.
*A01H 13/00* (2006.01)
*C12N 1/12* (2006.01)

(52) U.S. Cl.
USPC ..... 47/1.4; 417/53; 435/257.1

(58) Field of Classification Search
USPC ..... 417/18, 53; 47/1.4; 435/257.1; 104/73; 366/136, 137, 173.1, 173.2, 167.1; 119/207, 208, 209, 210, 211
See application file for complete search history.

(56) References Cited

U.S. PATENT DOCUMENTS 1,926,780 A * 9/1933 Lippincott ..... 104/73
3,220,706 A * 11/1965 Valdespino ..... 261/18.1
3,468,057 A * 9/1969 Buisson et al. ..... 435/257.1
3,897,000 A * 7/1975 Mandt ..... 239/722
3,955,318 A 5/1976 Hulls
4,003,337 A * 1/1977 Moore ..... 119/224
4,115,949 A 9/1978 Avron et al.
4,217,728 A 8/1980 Shimamatsu et al.
4,267,038 A * 5/1981 Thompson ..... 210/602
4,365,938 A * 12/1982 Warinner ..... 417/54
4,535,060 A 8/1985 Comai
4,658,757 A * 4/1987 Cook ..... 119/233
4,813,611 A 3/1989 Fontana
5,105,085 A 4/1992 McGuire et al.
5,130,242 A 7/1992 Barclay
5,227,360 A 7/1993 Sherba et al.
5,338,673 A 8/1994 Thepenier et al.
5,353,745 A * 10/1994 Fahs, II ..... 119/226
5,478,208 A * 12/1995 Kasai et al. ..... 417/53

(Continued)

FOREIGN PATENT DOCUMENTS

CN 102164492 A1 8/2011
CN 102348793 A1 2/2012

(Continued)

OTHER PUBLICATIONS

Kizililsoley, Mustafa et al., Micro-Algae Growth Technology Systems, Presented by Selim Helvacioglu, Soley Institute 2008.*

(Continued)

*Primary Examiner* — Devon Kramer
*Assistant Examiner* — Nathan Zollinger
(74) *Attorney, Agent, or Firm* — Carr & Ferrell LLP

(57) ABSTRACT

Systems, methods and media for generating fluid flow in an algae cultivation pond are disclosed. Circulation of fluid in the algae cultivation pond is initiated via at least one jet. The circulation of fluid generates a velocity of fluid flow of at least ten centimeters per second in the algae cultivation pond. A head is provided to the at least one jet that overcomes a head loss associated with the velocity of fluid flow of at least ten centimeters per second in the algae cultivation pond.

19 Claims, 5 Drawing Sheets

(56) References Cited

U.S. PATENT DOCUMENTS

| | | | | |
|---|---|---|---|---|
| 5,518,990 | A | 5/1996 | Ushio et al. | |
| 5,527,456 | A * | 6/1996 | Jensen | 210/170.01 |
| 5,539,133 | A | 7/1996 | Kohn et al. | |
| 5,564,630 | A | 10/1996 | Giles et al. | |
| 5,573,669 | A | 11/1996 | Jensen | |
| 5,658,076 | A * | 8/1997 | Crump et al. | 366/270 |
| 5,658,767 | A | 8/1997 | Kyle | |
| 5,823,781 | A | 10/1998 | Hitchcock et al. | |
| 5,871,952 | A | 2/1999 | Ghirardi et al. | |
| 6,000,551 | A | 12/1999 | Kanel et al. | |
| 6,117,313 | A * | 9/2000 | Goldman et al. | 210/151 |
| 6,166,231 | A | 12/2000 | Hoeksema | |
| 6,192,833 | B1 * | 2/2001 | Brune et al. | 119/204 |
| 6,372,460 | B1 | 4/2002 | Gladue et al. | |
| 6,447,681 | B1 | 9/2002 | Carlberg et al. | |
| 6,524,486 | B2 | 2/2003 | Borodyanski et al. | |
| 6,579,714 | B1 | 6/2003 | Hirabayashi et al. | |
| 6,626,738 | B1 | 9/2003 | Shank | |
| 6,736,572 | B2 * | 5/2004 | Geraghty | 405/211 |
| 6,750,048 | B2 | 6/2004 | Ruecker et al. | |
| 6,831,040 | B1 | 12/2004 | Unkefer et al. | |
| 6,871,195 | B2 | 3/2005 | Ryan et al. | |
| 6,896,804 | B2 | 5/2005 | Haerther et al. | |
| 6,944,013 | B2 | 9/2005 | Yang | |
| 7,381,326 | B2 * | 6/2008 | Haddas | 210/167.26 |
| 7,391,608 | B2 | 6/2008 | Tsai | |
| 7,669,780 | B2 | 3/2010 | Sugano et al. | |
| 7,682,821 | B2 | 3/2010 | Woods et al. | |
| 7,748,650 | B1 | 7/2010 | Sloan | |
| 7,770,322 | B2 | 8/2010 | Huntley et al. | |
| 8,143,051 | B2 | 3/2012 | Weissman et al. | |
| 8,507,254 | B1 | 8/2013 | Abuhasel | |
| 2002/0105855 | A1 * | 8/2002 | Behnke et al. | 366/167.1 |
| 2003/0038566 | A1 | 2/2003 | Qiu | |
| 2003/0116502 | A1 | 6/2003 | DeBusk et al. | |
| 2003/0140021 | A1 | 7/2003 | Ryan et al. | |
| 2003/0199490 | A1 | 10/2003 | Antoni-Zimmermann et al. | |
| 2004/0121447 | A1 | 6/2004 | Fournier | |
| 2004/0161364 | A1 | 8/2004 | Carlson | |
| 2004/0262219 | A1 | 12/2004 | Jensen | |
| 2005/0064577 | A1 | 3/2005 | Berzin | |
| 2005/0095569 | A1 | 5/2005 | Franklin | |
| 2005/0164192 | A1 | 7/2005 | Graham et al. | |
| 2005/0170479 | A1 | 8/2005 | Weaver et al. | |
| 2005/0181345 | A1 | 8/2005 | Bradbury et al. | |
| 2005/0260553 | A1 | 11/2005 | Berzin | |
| 2005/0273885 | A1 | 12/2005 | Singh et al. | |
| 2006/0031087 | A1 | 2/2006 | Fox et al. | |
| 2006/0044259 | A1 | 3/2006 | Hotelling et al. | |
| 2006/0045750 | A1 * | 3/2006 | Stiles | 417/42 |
| 2006/0122410 | A1 | 6/2006 | Fichtali et al. | |
| 2006/0155558 | A1 | 7/2006 | Corpening | |
| 2006/0166243 | A1 | 7/2006 | Su et al. | |
| 2006/0192690 | A1 | 8/2006 | Philipp | |
| 2007/0115626 | A1 | 5/2007 | Peng et al. | |
| 2007/0155006 | A1 | 7/2007 | Levin | |
| 2007/0289206 | A1 | 12/2007 | Kertz | |
| 2008/0118964 | A1 | 5/2008 | Huntley et al. | |
| 2008/0120749 | A1 | 5/2008 | Melis et al. | |
| 2008/0155888 | A1 | 7/2008 | Vick et al. | |
| 2008/0155890 | A1 * | 7/2008 | Oyler | 47/1.4 |
| 2008/0160488 | A1 | 7/2008 | Younkes et al. | |
| 2008/0160591 | A1 | 7/2008 | Willson et al. | |
| 2008/0160593 | A1 | 7/2008 | Oyler | |
| 2008/0220486 | A1 | 9/2008 | Weiss | |
| 2008/0293132 | A1 | 11/2008 | Goldman et al. | |
| 2009/0011492 | A1 | 1/2009 | Berzin | |
| 2009/0029445 | A1 | 1/2009 | Eckelberry et al. | |
| 2009/0061928 | A1 | 3/2009 | Lee et al. | |
| 2009/0126265 | A1 | 5/2009 | Rasmussen et al. | |
| 2009/0137031 | A1 | 5/2009 | Hirabayashi | |
| 2009/0148931 | A1 | 6/2009 | Wilkerson et al. | |
| 2009/0151241 | A1 | 6/2009 | Dressler et al. | |
| 2009/0162919 | A1 | 6/2009 | Radaelli et al. | |
| 2009/0186860 | A1 | 7/2009 | Huff et al. | |
| 2009/0234146 | A1 | 9/2009 | Cooney et al. | |
| 2009/0319338 | A1 | 12/2009 | Parks et al. | |
| 2009/0325270 | A1 | 12/2009 | Vick et al. | |
| 2010/0022393 | A1 | 1/2010 | Vick | |
| 2010/0068772 | A1 | 3/2010 | Downey | |
| 2010/0100520 | A1 | 4/2010 | Dargue et al. | |
| 2010/0170149 | A1 | 7/2010 | Keeler et al. | |
| 2010/0170150 | A1 | 7/2010 | Walsh, Jr. | |
| 2010/0183744 | A1 | 7/2010 | Weissman et al. | |
| 2010/0196995 | A1 | 8/2010 | Weissman et al. | |
| 2010/0198659 | A1 | 8/2010 | Meltzer et al. | |
| 2010/0210003 | A1 * | 8/2010 | King et al. | 435/257.1 |
| 2010/0257781 | A1 | 10/2010 | Batty et al. | |
| 2010/0260618 | A1 | 10/2010 | Parsheh et al. | |
| 2010/0261922 | A1 | 10/2010 | Fleischer et al. | |
| 2010/0314324 | A1 | 12/2010 | Rice et al. | |
| 2010/0323387 | A1 | 12/2010 | Bailey et al. | |
| 2010/0325948 | A1 | 12/2010 | Parsheh et al. | |
| 2010/0327077 | A1 | 12/2010 | Parsheh et al. | |
| 2011/0016773 | A1 | 1/2011 | Nichols et al. | |
| 2011/0023360 | A1 | 2/2011 | Ryan et al. | |
| 2011/0051354 | A1 | 3/2011 | Fan et al. | |
| 2011/0136212 | A1 | 6/2011 | Parsheh et al. | |
| 2011/0197306 | A1 | 8/2011 | Bailey et al. | |
| 2011/0258915 | A1 | 10/2011 | Subhadra | |
| 2011/0287531 | A1 | 11/2011 | Hazlebeck | |
| 2011/0287544 | A1 | 11/2011 | Berzin et al. | |
| 2012/0252104 | A1 | 10/2012 | Waibel et al. | |
| 2012/0272574 | A1 | 11/2012 | Parsheh et al. | |
| 2013/0130909 | A1 | 5/2013 | Vick et al. | |

FOREIGN PATENT DOCUMENTS

| | | | |
|---|---|---|---|
| CN | 102459585 | A1 | 5/2012 |
| CN | 102575221 | A1 | 7/2012 |
| EP | 2427551 | A1 | 3/2012 |
| HK | 1168381 | A1 | 12/2012 |
| JP | 09173050 | A | 7/1997 |
| MX | 20110000934 | A1 | 7/2011 |
| MX | 2011008222 | A1 | 1/2012 |
| WO | WO2004/106238 | A2 | 12/2004 |
| WO | WO2009037683 | A1 | 3/2009 |
| WO | WO2009149519 | A1 | 12/2009 |
| WO | WO2010/011335 | A1 | 1/2010 |
| WO | WO2010008490 | A1 | 1/2010 |
| WO | WO2010090760 | A1 | 8/2010 |
| WO | WO2010/129041 | A1 | 11/2010 |
| WO | WO2010/147648 | A1 | 12/2010 |
| WO | WO2011/002487 | A1 | 1/2011 |
| WO | WO2012149214 | A1 | 11/2012 |
| WO | WO2012170737 | A1 | 12/2012 |

OTHER PUBLICATIONS

Ben-Amotz, Ami, Large Scale Open Algae Ponds, Presented at the NREL-AFOSR Joint Workshop on Algal Oil for Jet Fuel Production in Feb. 2008.*

Andersen, Robert A., Algal Culturing Techniques, 2005, p. 208.*

Labatut et al. Hydrodynamics of a Large-scale Mixed-Cell Raceway: Experimental studies, Aquacultural Engineering, 37 (2), p. 132, Sep. 2007.*

Kent BioEnergy, "Fish farm empties its ponds to grow algae for biofuels", Apr. 17, 2009 (http://www-csgc.ucsd.edu/newsroom/newsreleases/2009/algaeforbiofuls.html).*

Santin-Montanaya, I. Optimal growth of *Dunaliella primolecta* in axenic conditions to assay herbicides, Chemosphere, 66, Elsevier 2006, pp. 1315-1322.

Felix, R. Use of the cell wall-less alga *Dunaliella bioculata* in herbicide screening tests, Annals of Applied Biology, 113, 1988, pp. 55-60.

Janssen, M. Photosynthetic efficiency of *Dunaliella tertiolecta* under short light/dark cycles, Enzyme and Microbial Technology, 29, 2001, pp. 298-305.

Saenz, M.E. Effects of Technical Grade and a Commercial Formulation of Glyphosate on Algal Population Growth, Bulletin of Environmental Contamination Toxicology, 1997, pp. 638-644.

Anderson, Robert A., Algal Culturing Techniques, 2005. p. 208.

(56) References Cited

OTHER PUBLICATIONS

Berberoglu et al. "Radiation characteristics of *Chlamydomonas reinhardtii* CC125 and its truncated chlorophyll antenna transformants tla1, tlaX, and tla 1-CW+" International Journal of Hydrogen Energy. 2008 vol. 33 pp. 6467-6483, especially the abstract.
Cohen (Chemicals from microalgae 1999, CRC Press, pp. 49 and 51 in part).
Csogor et al. "Light distribution in a novel photobioreactor—modeling for optimization" Journal of Applied Phycology, vol. 13, p. 325-333, May 2001, Entire document, especially: abstract; p. 110, col. 1-2 [online]. Retrieved from the Internet on [Oct. 5, 2010]. Retrieved from: <URL: http://www.springerlink.com/content/p77j66g3j2133522/fulltext.pdf.
Ebeling et al. "Design and Operation of a Zero-Exchange Mixed-Cell Raceway Production System" 2nd International Sustainable Marine Fish Culture Conference and Workshop, Oct. 19-21, 2005. Entire Document.
Ebeling et al. "Mixed-Cell Raceway: Engineering Design Criteria, Construction, and Hydraulic Characterication" North American Journal of Aquaculture 2005; 67: 193-201. Abstract only.
Ghirardi et al. "Photochemical apparatus organization in the thylakoid membrane of *Hordeum vulgare* wild type and chlorophyll b-less chlorina f2 mutant." Biochimica et Biophysica Acta (BBA)—Bioenergetics. vol. 851, Issue 3, Oct. 8, 1986, pp. 331-339 (abstract only).
Janssen et al. "Enclosed outdoor photobioreactors: light regime, photosynthetic efficiency, scale-up, and future prospects" Biotechnology and Bioengineering, vol. 81, No. 2, p. 193-210, Jan. 20, 2003, Entire document, especially: Fig 4, p. 198 [online]. Retrieved from the Internet on [Oct. 5, 2010]. Retrieved from: <URL: http://onlinelibrary.wiley.com/doi/10.1002bit.10468/pdf.
Koller et al. Light Intensity During Leaf Growth Affects Chlorophyll Concentration and CO2 Assimilation of a Soybean Chlorophyll Mutant. Crop Sci. 1974. vol. 14 pp. 779-782 (abstract only).
Kureshy et al. "Effect of Ozone Treatment on Cultures of *Nannochloropsis oculata, Isochrysis galbana*, and *Chaetoceros gracilis*." Journal of the World Aquaculture Society, Dec. 1999, vol. 30, No. 4, pp. 473-480; p. 473, Abstract, p. 475, "*Nannochloropsis oculata*" Section; p. 476, Table 1; p. 476, Table 2; p. 479, left column, para 2.
Lee et al. "Isolation and Characterization of a Xanthophyll Aberrant Mutant of the Green Alga *Nannochloropsis oculata*" Marine Biotechnology vol. 8, 238-245 (2006) (p. 239 col. 1 para 1; p. 239 col. 2 para 4; p. 240 col. 1 para 2; p. 242 col. 2 para 2; p. 241 Table 1, Fig 2; p. 242 Table 2).
Roessler et al. (Generic Engineering Approaches for Enhanced Production of Biodiesel Fuel from Microalgae, ACS Symposium Series; American Chemical Society, 1994; p. 255-270).
Shikanai et al. "Identification and Characterization of *Arabidopsis* Mutants with Reduced Quenching of Chlorophyll Fluorescence." Plant and Cell Physiology, 1999, vol. 40, No. 11. pp. 1134-1142 (abstract only).
Steinitz et al. "A mutant of the cyanobacterium *Plectonema boryanum* resistant to photooxidation" Plant Science Letters. vol. 16, Issues 2-3, Oct. 1979, pp. 327-335 (abstract only).
Strzepek et al., "Photosynthetic architecture differs in coastal and oceanie diatoms" Nature vol. 431, p. 689-692, Oct. 7, 2004. Entire document, especially: abstract, p. 689, col. 2; p. 691, Table 1 [online] Retrieved from the Internet on [Oct. 5, 2010]. Retrieved from: URL:http://www.nature.com/nature/journal/v431/n7009/pdf/nature02954.pdf.
Zittelli et al. "Mass cultivation of *Nannochloropsis* sp. In annular reactors" Journal of Applied Phycology vol. 15, p. 107-113, Mar. 2003. Entire document, especially: abstract; p. 110, col. 1-2 [online]. Retrieved from the Internet on [Oct. 5, 2010]. Retrieved from: <URL: http://www.springerlink.com/content/v77772k1mp081775/fulltext.pdf.
Applying [online] retrieved from: http://www.merriam-webster.com/dictionary/applying, on May 21, 2011;3 pages.
IN Journal37/2013, IN, A1, Sep. 13, 2013, Vick et al., IN Cumulative version of WO2010011335.
IN Journal12/2013, IN, A1, Mar. 22, 2013, Parsheh et al., IN Cumulative version of WO2010147648.
IN Journal52/2012, IN, A1, Dec. 28, 2012, Weissman et al., IN Cumulative version of WO2010090760.
IN Journal20/2013, IN, A1, May 17, 2013, Bailey et al., IN Cumulative version of WO2010129041.
Palanichamy et al (Observations on the long term preservation and culture of the marine microalga, *Nannochloropsis oculata*, 2004, Journal of Marine Biology Association of India, vol. 46, pp. 98-103).
Office Action mailed Nov. 11, 2013 in Mexican Application No. MX/a/2011/000934 filed Jul. 24, 2009.
Christy et al., "Effects of Glyphosate on Growth of *Chlorella*," Weed Science, vol. 29, Issue 1, Jan. 1981, pp. 5-7.
Grima et al. "Recovery of Microalgal Biomass in Metabolites: Process Options and Economics," Biotechnology Advances 20, 2003, pp. 491-515.
Knuckey et al. "Production of Microalgal Concentrates by Flocculation and their Assessment as Aquaculture Feeds," Aquacultural Engineering 35, 2006, pp. 300-313.
Liao et al. "An Overview of Live Feeds Production System Design in Taiwan," Rotifer and Microalgae Culture Systems, Proceedings of a US-Asia Workshop, Honolulu, HI, 1991, pp. 135-150.
Kanematsu et al., "Methods to Repress the Growth of a *Nannochloropsis*-Grazing Microflagellate," Nippon Suisan Gakkaishi 55, 1989, pp. 1349-1352 (English Translation).
NCBI entry EE109892 (Jul. 2006) [Retrieved from the Internet on Oct. 19, 2009, <http://www.ncbi.nlm.nih.gov/nucest/EE109892?ordinalops=1&itool=EntrezSystem2.Pentrez.Sequence.Sequence_ResultsPanel.Sequence_RVDocSum>].
Hoyt et al., "Waves on Water Jets," J. Fluid Mech., 1977, vol. 83, Part 1, pp. 119-127.
Dodd, "Elements of Pond Design and Construction," CRC Handbook of Microalgal Mass Culture, Richmond, ed., Boca Raton, FL.: CRC Press, 1986, pp. 265-283, see entire document, especially Fig. 1; p. 268, para. 3 to p. 269, para. 1; p. 270, para. 1.
Mitra et al., "Optical Properties of Microalgae for Enhanced Biofuels Production," Optics Express, Dec. 2008, vol. 16, No. 26.
Rodolphi et al., "Microalgae for Oil: Strain Selection, Induction of a Lipid Synthesis and Outdoor Mass Cultivation in a Low-Cost Photobioreactor," Biotechnology and Bioengineering, 2008, vol. 102, No. 1, pp. 100-112.
International Search Report mailed Sep. 16, 2009 for Application No. PCT/US2009/004296, filed Jul. 24, 2009.
Written Opinion of the International Searching Authority mailed Sep. 16, 2009 for Application No. PCT/ US2009/004296, filed Jul. 24, 2009.
Office Action mailed Nov. 14, 2012 in China Patent Application No. 200980138072.X, filed Jul. 24, 2009.
Official Action mailed Jul. 10, 2012 in Mexico Patent Application No. MX/a/2011/000934, filed Jul. 24, 2009.
Official Action mailed Mar. 5, 2013 in Mexico Patent Application No. MX/a/2011/000934, filed Jul. 24, 2009.
Duarte et al., "Glyphosate (GP) Effects with Emphasis on Aquatic Organisms," Colunbia Orinoquia, ISSN: 0121-3709, pp. 70-100, 2004.
Technical Card: Glyphosate, Document filed for the Pesticide Action Network and the Alternatives Thereof, for Latin America (RAP-AL)—Communications and Administration Office, Apr. 2008.
Department of Environment, Housing and Territorial Development Ministry, Resolution (1009), published Jun. 17, 2008.
International Search Report and Written Opinion of the International Searching Authority mailed May 3, 2010 for Application No. PCT/US2010/000346, filed Feb. 4, 2010.
Patent Examination Report No. 1 mailed Jan. 9, 2013 in Australia Patent Application 2010210982, filed Feb. 4, 2010.
First Office Action mailed Nov. 5, 2012 in China Patent Application No. 201080012755.3, filed Feb. 4, 2010.
Official Action mailed Sep. 17, 2012 in Mexico Patent Application No. MX/a/2011/008222, filed Feb. 4, 2010.

(56) References Cited

OTHER PUBLICATIONS

International Search Report and Written Opinion of the International Searching Authority mailed Aug. 30, 2010 for Application No. PCT/US2010/001731, filed Jun. 15, 2010.
Notice on the First Office Action mailed Dec. 14, 2012 in Chinese Application No. 201080036170.5 filed Jun. 15, 2010.
International Search Report and Written Opinion of the International Searching Authority mailed Aug. 19, 2010 for Application No. PCT/US2010/001755, filed Jun. 16, 2010.
International Search Report and Written Opinion of the International Searching Authority mailed Jul. 31, 2012 for Application No. PCT/US2012/035290, filed Apr. 26, 2012.
International Search Report and Written Opinion of the International Searching Authority mailed Jul. 30, 2010 for Application No. PCT/US2010/001315, filed May 4, 2010.
First Office Action mailed Oct. 25, 2012 in China Patent Application No. 201080027531.X, filed May 4, 2010.
Extended European Search Report mailed Oct. 5, 2012 in European Patent Application 10772376.9, filed on May 4, 2010.
Polle et al., "tla1, a DNA insertional transformant of the green alga *Chlamydomonas reinhardtii* with a truncated light-harvesting chlorophyll antenna size," Planta, vol. 217, No. 1, May 2003, pp. 49-59.
Lawrence et al., "Variation in Plants Regenerated from Vacuolate and Evacuolate Protoplasts," Plant Science, vol. 50, No. 2, 1987, pp. 125-132.
Beckmann et al., "Improvement of light to biomass conversion by de-regulation of light-harvesting protein translation in *Chlamydomonas reinhardtii*," Journal of Biotechnology, vol. 142, No. 1, 2009, pp. 70-77.
International Search Report and Written Opinion of the International Searching Authority mailed Aug. 16, 2012 for Application No. PCT/US2012/041425, filed Jun. 7, 2012.
European Search Report mailed Oct. 5, 2012 in European Patent Application No. 10772376.9, filed May 4, 2010.
Examination Report mailed Feb. 20, 2013 in Australian Application No. 2009274500 filed Jul. 24, 2009.
Notice on the Second Office Action mailed Jun. 20, 2013 in Chinese Application No. 201080012755.3 filed Feb. 4, 2010.
Notice on the Second Office Action mailed Jul. 5, 2013 in Chinese Application No. 201080027531.X filed May 4, 2010.
Examination Report mailed Aug. 22, 2013 in Australian Application No. 2010260530 filed Jun. 15, 2010.
First Office Action mailed Aug. 29, 2013 in Mexican Application No. MX/a/2011/013710 filed Jun. 15, 2010.
Examination Report mailed Aug. 29, 2013 in European Application No. 10772376.9 filed May 4, 2010.
Examination Report mailed Sep. 19, 2013 in Australian Application No. 2010245255 filed May 4, 2010.
Notice on the Second Office Action mailed Sep. 24, 2013 in Chinese Application No. 200980138072.X filed Jul. 24, 2009.
Zuo-Xi Ruan et al., Effects of Acute Glyphosate Exposure on the Growth and Physiology of *Nostoc sphaeroides*, an Edible Cyanobacterium of Paddy Rice Fields, Acta Hydrobiologica Sinica, Jul. 2008 vol. 32, No. 4.
HCAPLUS abstract 1997; 248650 (1997).
HCAPLUS abstract 2005; 600349 (2005).
HCAPLUS abstract 2007; 1143765 (2007).
Notice on the Second Office Action mailed Oct. 24, 2013 in Chinese Application No. 201080036170.5 filed Jun. 15, 2010.
Tucker (Water Treatment, 1998, Springer, pp. 1-754).
Vinneras et al (The potential for disinfection of separated faecal matter by urea and by peracetic acid for hygienic nutrient recycling, 2003, Bioresources Technology, vol. 89, pp. 155-161).
CCAP website, f2 media recipe, 2005.
U.S. Appl. No. 12/704,035, filed Feb. 11, 2010.

* cited by examiner

SYSTEMS, METHODS, AND MEDIA FOR CIRCULATING FLUID IN AN ALGAE CULTIVATION POND

FIELD OF INVENTION

The present invention relates generally to movement of fluid in an aquaculture, and more particularly to the use of jets for initiating the circulation of fluid in an aquaculture, such as an algae cultivation pond.

BRIEF SUMMARY OF THE INVENTION

Provided herein are exemplary systems, methods and media for generating fluid flow in an algae cultivation pond via the use of jets. In a first aspect, a method for generating fluid flow in an algae cultivation pond is disclosed. Circulation of fluid in the algae cultivation pond is initiated via at least one jet. The circulation of fluid generates a velocity of fluid flow of at least ten centimeters per second in the algae cultivation pond. A head is provided to the at least one jet that overcomes a head loss associated with the velocity of fluid flow of at least ten centimeters per second in the algae cultivation pond.

In a second aspect, a system for generating fluid flow via a jet in an algae cultivation pond is disclosed. The system includes at least two submerged jets configured to initiate circulation of fluid in an algae cultivation pond. The system is configured such that a head generated by the at least two jets overcomes a head loss of the algae cultivation pond when a velocity of the fluid flow in the algae cultivation pond is at least ten centimeters per second.

In a third aspect, a system for generating fluid flow via a jet in an algae cultivation pond is disclosed. The system includes a series of nozzles coupled to a pressurized fluid source. The series of nozzles is submerged below a surface of an algae cultivation pond. The system includes a processor and a computer-readable storage medium having embodied thereon a program executable by the processor to perform a method for generating fluid flow in an algae cultivation pond. The computer-readable storage medium is coupled to the processor and the pressurized fluid source. The processor executes the instructions on the computer-readable storage medium to measure a velocity of fluid flow in the algae cultivation pond and adjust an energy generated by the pressurized fluid source.

The methods described herein may be performed via a set of instructions stored on storage media (e.g., computer readable media). The instructions may be retrieved and executed by a processor. Some examples of instructions include software, program code, and firmware. Some examples of storage media comprise memory devices and integrated circuits. The instructions are operational when executed by the processor to direct the processor to operate in accordance with embodiments of the present invention. Those skilled in the art are familiar with instructions, processor(s), and storage media.

DETAILED DESCRIPTION

Figure 1:
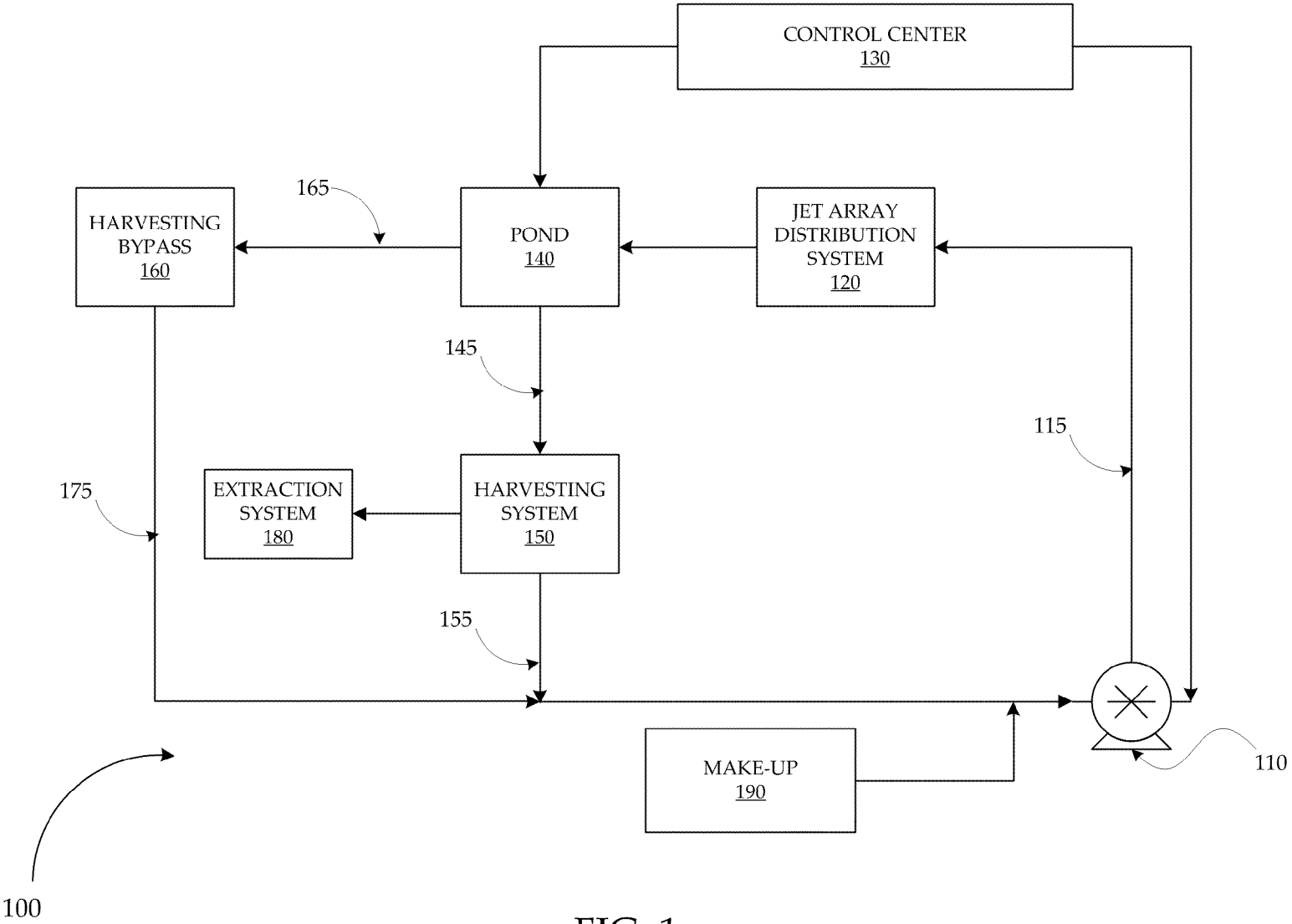
FIG. 1 illustrates an exemplary jet circulation system in accordance with embodiments of the present invention.

Provided herein are exemplary systems, methods and media for generating fluid flow in an algae cultivation pond via the use of jets. Algae may be suspended in a fluid in the algae cultivation pond, e.g. algae cultivation pond fluid. The algae cultivation pond fluid may include for example, a mixture of fresh water and seawater, nutrients to promote algae growth, dissolved gases, disinfectants, waste products, and the like. The algae cultivation pond may exploit the natural process of photosynthesis in order to produce algal biomass and lipids for high-volume applications, such as the production of biofuels.

The resultant flow from the jet, or jet flow, may entrain the algae cultivation pond fluid. In some embodiments, a co-flow associated with algae cultivation pond fluid may be continuously entrained into the jet flow and yield a substantially homogeneous mixture downstream from the jets. The jet flow may induce bulk movement of fluid in the algae cultivation pond, e.g. circulation, or pond flow.

The use of a jet circulation system in an algae cultivation pond may provide several unexpected advantages that in turn, may raise the productivity, e.g. algal yield per unit area, of the algae cultivation pond. For example, a jet circulation system may accommodate for head losses associated with flow velocities greater than or equal to 10 cm/s. The jet circulation system may promote uniform velocity in algae cultivation pond fluid, which may account for lower head losses in the algae cultivation pond. Uniform flow velocity in the algae cultivation pond may promote homogeneity in the algae cultivation pond fluid. Increased homogeneity may promote, for example, enhanced delivery of nutrients, dissolved gases such as carbon dioxide, and/or enhanced temperature distribution in the algae cultivation pond fluid. Uniform flow velocity may also reduce stagnation of fluid in the algae cultivation pond. Reduced stagnation of fluid associated with uniform flow velocity may prevent "dead zones," or regions of low algal productivity.

The use of a jet circulation system may increase turbulence intensity and formation of large vortices in the algae cultivation pond fluid. Increases in turbulence intensity may promote the release of byproducts that may be dissolved in the algae cultivation pond fluid. For instance, algae produce oxygen during the course of photosynthesis, which is dissolved in solution upon production. Turbulence in the algae cultivation pond flow may promote the release of dissolved oxygen out of solution into the atmosphere. The externally imposed oxygen release due to turbulence of the algae cultivation pond fluid thus maintains the capacity of the algae cultivation pond fluid to absorb oxygen and may, in turn, promote algal photosynthesis. Thus, photosynthetic efficiency of the algae may increase and higher algal yields may be realized. In addition, the jets may provide enough momentum to the algae cultivation pond fluid such that the increased turbulence intensity may be sustained far downstream of the jet. Thus, the release of oxygen and other benefits of increased turbulence may be global phenomena in the algae cultivation pond.

Increases in turbulence intensity may promote small-scale fluctuations in the flow velocity of algae cultivation pond fluid, which in turn increase the rate-of-rotation and fluctuating rate-of-strain of the flow. Such fluctuations in rate-of-strain promote the formation of eddies, which encourage vertical and lateral mixing of algae cultivation pond fluid. Increases in turbulence intensity may result in a turbulent boundary layer at the algal cell and enhance the rate of mass transfer to the algal cells, thereby enhancing the uptake of various nutrients and carbon dioxide. Additionally, increased fluctuating velocity may promote algae turnover at the surface, providing light exposure to algae at different levels in the culture.

In some embodiments, the entrainment of algae cultivation pond fluid into the jets may be maximized. Jet entrainment may be significantly increased by generating large scale coherent vortices, in particular, vortex rings. The formation of vortex rings may be induced by the roll-up of the jet shear layer. Increased roll-up of the jet shear layer may occur when the boundary layer in the nozzle from which the jet is issued is laminar. The presence of a higher flow velocity in the algae cultivation pond may affect the jet shear layer and therefore the roll-up of the jet shear layer.

The systems, methods, and media presented herein may make use of energy sources in order to provide momentum to the jets. In some embodiments, it may be desirable to maximize the energy efficiency of the algae cultivation pond system in order to minimize energy input. Alternatively, it may be desirable to maximize the turbulence intensity in the pond, which may involve increased energy consumption. The objectives of maximizing energy efficiency and maximizing turbulence may be reconciled and adjusted in real time.

FIG. 1 illustrates an exemplary jet circulation system 100 in accordance with the embodiments presented herein. The jet circulation system 100 includes a pump 110, a jet array distribution system 120, a control center 130, a pond 140, a harvesting system 150, a harvesting bypass 160, an extraction system 180, and a make-up 190. The pump 110 may be, for example, a centrifugal pump. The jet array distribution system 120 is coupled to the pump 110 and configured to generate jets from pressurized fluid provided by the pump 110. Further components of the jet array distribution system 120 are illustrated and described in the context of FIG. 2. One skilled in the art will appreciate that any number of items 110-190 may be present in the jet circulation system 100. For example, any number of jet array distribution systems 120 may be present in a pond 140, and multiple ponds 140 may be present in jet circulation system 100. For all figures mentioned herein, like numbered elements refer to like elements throughout.

In some embodiments, fluid may be pumped from the pump 110 to the jet array distribution system 120 via a path 115. The pump 110 provides energy to move the fluid to jet array distribution system 120, thereby pressurizing the fluid. The jet array distribution system 120 may generate jets from the pressurized fluid and discharge the jets into the pond 140. The flow associated with the discharged jets, or jet flow, may have a higher dynamic pressure due to the increased energy generated by the pump 110. The fluid from the jets may entrain the algae cultivation pond fluid (not shown in FIG. 1) and produce a homogeneous mixture of algae cultivation pond fluid downstream of the jets. The jet flow, when brought in contact with the algae cultivation pond fluid, which has lower dynamic pressure, may promote circulation of the algae cultivation pond fluid.

The jet circulation system 100 may serve as a cultivation system for large quantities of algae. For instance, the jet circulation system 100 may be used to cultivate algae for large volume applications, such as in the production of biofuels. The jet circulation system 100 as such may be coupled to, for example, a harvesting system 150 and/or an extraction system 180. Algae may be harvested periodically from the pond 140, e.g. an algae cultivation pond. When harvesting is taking place, algae cultivation pond fluid may be routed from the pond 140 via a path 145. Upon harvesting, algae biomass may be routed to an extraction system 180 and algae cultivation pond fluid may be routed to the pump 110 via a path 155. Alternatively, the algae cultivation pond fluid may be discarded (not shown in FIG. 1).

In order to maintain a desired level of algae cultivation pond fluid, a harvesting bypass 160 may be available in jet circulation system 100. The harvesting bypass 160 may include an overflow component, which may act as a reservoir for surplus algae cultivation pond fluid (overflow component not shown in FIG. 1). The harvesting bypass 160 may be used to store excess algae cultivation pond fluid when harvesting is not taking place, such as during maintenance and repair, cleaning, or unfavorable weather conditions. In such scenarios, algae cultivation pond fluid may be routed via a path 165 to the harvesting bypass 160, and then via a path 175 to the pump 110.

Components may be added to jet circulation system 100 based on conditions that may play a role in algae cultivation and/or the needs of the particular genus or species of algae being cultivated. For instance, algae cultivation ponds having several acres of exposed surface area may lose large quantities of water via evaporation to the surrounding environment. Evaporation therefore may change concentrations of various nutrients and/or disinfectants in the algae cultivation pond fluid as well as the temperature of the remaining fluid. In order to maintain desired concentrations of these nutrients and/or disinfectants, a make-up 190 may be available in jet circulation system 100. The make-up 190 may introduce additional fresh water, seawater, disinfectants, and/or nutrients such as Aqua Ammonia, Phosphorous solutions, and trace metals, such as Co, Zn, Cu, Mn, Fe and Mo in appropriate concentrations. In some embodiments, the make-up 190 may draw fluid from the harvesting bypass 160 (path not shown in FIG. 1).

The pump 110, the jet array distribution system 120, the pond 140, the harvesting system 150, the harvesting bypass 160, the extraction system 180, and the make-up 190 may be controlled and/or otherwise monitored by the control center 130. The control center 130 may include any number of components, e.g. sensors, gauges, probes, control valves, servers, databases, clients, control systems and any combination of these (not shown in FIG. 1 for simplicity). The sensors, servers, databases, clients and so forth may be communicative with one another via any number or type of networks, for example, LAN, WAN, Internet, mobile, and any other communication network that allows access to data, as well as any combination of these. Clients may include, for example, a desktop computer, a laptop computer, personal digital assistant, and/or any computing device. The control center 130 may monitor and/or measure various parameters in the pond 140, such as pH, head velocity, the head loss associated with the pond flow velocity, temperature, nutrient concentration, concentration of disinfectant, algal density, dissolved oxygen content, turbidity, and the like. The control center 130 may display and/or generate reports based on the various parameters measured in the pond 140.

The control center 130 may store and/or execute software programs and/or instructions in order to take action based on the measured parameters. For instance, the control center 130 may execute a module which compares measured parameters from the pond 140 to a desired set of parameters. If the measured parameters are not within a predetermined range of the desired set of parameters (e.g., within ten percent), the control center 130 may make adjustments via execution of a set of instructions (e.g., a software routine), to any of the pump 110, the jet array distribution system 120, the pond 140, the harvesting system 150, the harvesting bypass 160, the extraction system 180, and the make-up 190 in order to bring the measured parameters within the predetermined ranges. For instance, if the pH of the algae cultivation pond fluid drops to an undesirable level, e.g. a pH of 4, the control center 130 may provide instructions to the pump 110 to draw fluid from the make-up 190.

Figure 2:
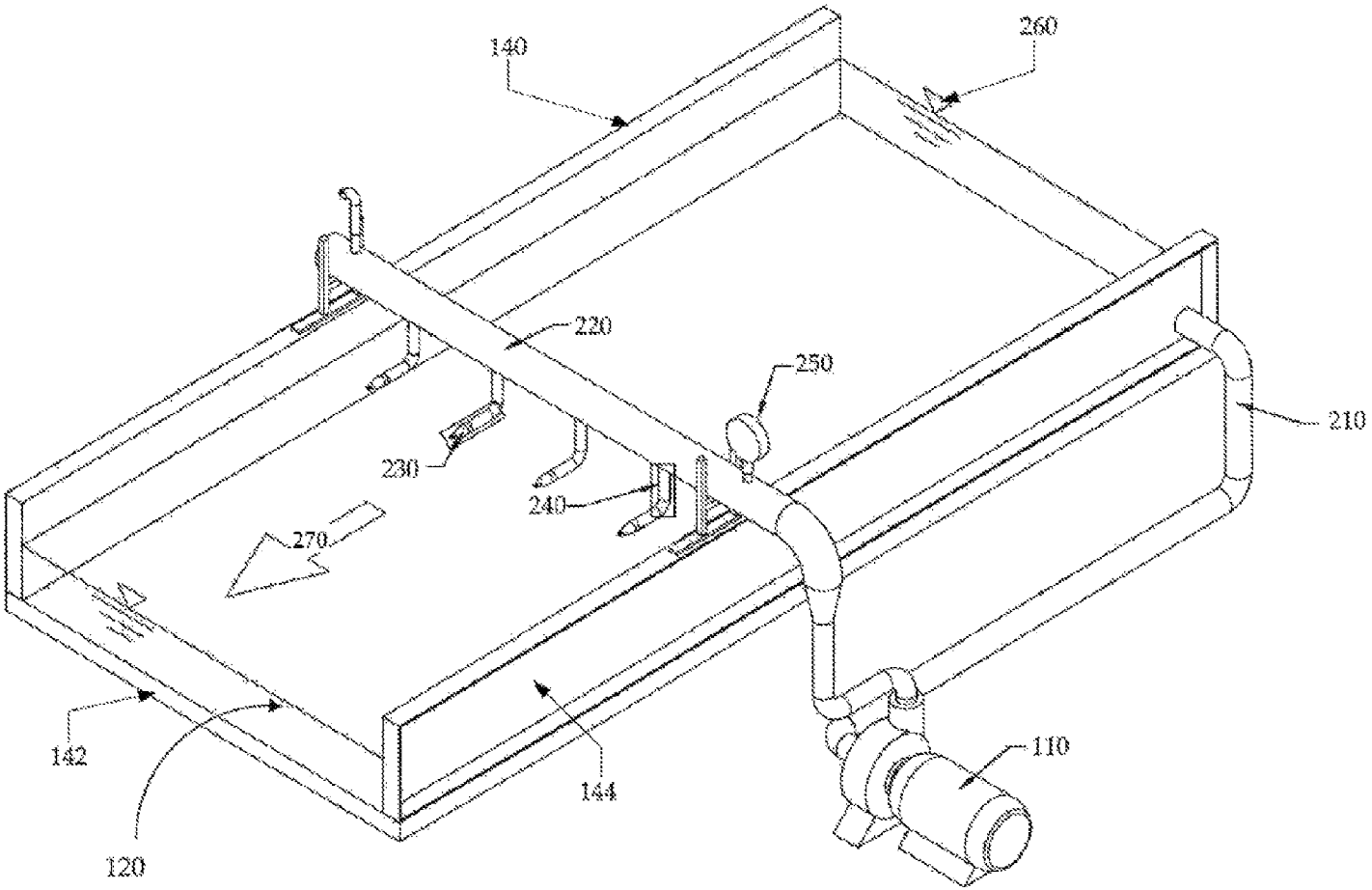
FIG. 2 illustrates an embodiment of a jet array distribution system as described in the context of FIG. 1.

FIG. 2 illustrates an embodiment of jet array distribution system 120 as described in the context of FIG. 1. As shown in FIG. 2, portions of the jet array distribution system 120 may be situated in the pond 140. Components of jet array distribution system 120 may include an intake 210, a manifold 220, a nozzle 230, a spout 240, and a gauge 250. FIG. 2 further illustrates algae cultivation pond fluid in the pond 140, a surface of which is indicated by a surface level marker 260. The nozzle 230 is submerged in the algae cultivation pond fluid. FIG. 2 further illustrates algae cultivation pond fluid in the pond 140, a surface of which is indicated by a surface level marker 260. The nozzle 230 is submerged in the algae cultivation pond fluid. The direction of circulation, or bulk flow of algae cultivation pond fluid, is indicated by 270. One skilled in the art will recognize that any number of components 210-260 may be present in jet array distribution system 120.

In some embodiments, algae cultivation pond fluid may be provided to the pump 110 via an intake 210 as shown in FIG. 2. The intake 210 may provide fluid in the algae cultivation pond to the pump 110, as shown in FIG. 2. Alternatively, the intake 210 may provide algae cultivation pond fluid from a component shown in FIG. 1, such as the harvesting system 150, the harvesting bypass 160, and/or the make-up 190.

Upon intake of algae cultivation pond fluid, the pump 110 may provide the algae cultivation pond fluid to the manifold 220. The pump 110 may provide energy to the algae cultivation pond fluid in order to transport the algae cultivation pond fluid to the manifold. Energy provided by the pump 110 may pressurize the algae cultivation pond fluid. The manifold 220 may distribute the pressurized algae cultivation pond fluid to the nozzles 230. One skilled in the art will recognize that the manifold 220 may be configured to provide algae cultivation pond fluid to any number of nozzles 230 and not just to four nozzles 230 as shown in FIG. 2. For instance, a single nozzle 230 may provide circulation in the algae cultivation pond.

The nozzles 230 may generate jets from the pressurized algae cultivation pond fluid (jets not shown in FIG. 2). A flow associated with the jets may provide kinetic energy to a pond flow in the algae cultivation pond. Per the "Law of Continuity" and "Law of Conservation of Energy" the flow in the pond, which includes the jet flow and the entrained co-flow, obtains a velocity from the jet flow. The kinetic energy of the jet flow translates into a higher static pressure. Since the pond flow has a free surface, as indicated by surface level marker 260, the higher static pressure translates into a head, thereby initiating and/or maintaining circulation of algae cultivation pond fluid in the algae cultivation pond.

The flow associated with the jets, e.g. jet flow, may entrain the co-flow into the jets downstream of the nozzles 230. The entrainment of the co-flow into the jet flow may allow for distribution of nutrients, dissolved gases, minerals, and the like. In some embodiments, one jet may issue per nozzle 230. An array of jets may be generated from the jet array distribution system 120 based on a placement of nozzles relative to each other. An exemplary nozzle array is further shown in FIG. 4.

The nozzles 230 may be placed at any flow depth in the pond 140. Flow depth may be characterized as a perpendicular distance between a free surface of the algae cultivation pond fluid as indicated by surface level marker 260, and the floor 142. Flow depth may be measured immediately downstream of the jets. A preferred range for flow depth may range from ten to thirty centimeters. Nozzle depth may be characterized as a perpendicular distance between a free surface of the algae cultivation pond fluid as indicated by surface level marker 260, and an outlet of a nozzle 230. A nozzle depth may be characterized relative to the flow depth, e.g. the nozzle depth may be halfway between the free surface of the algae cultivation pond fluid and the floor 142. In such characterizations, the nozzle depth may be characterized as in, or approximately in, the "middle" of the flow depth. An exemplary nozzle depth for the nozzles 230 in the jet array distribution system 120 may range from seven to fifteen centimeters from the free surface of the algae cultivation pond fluid in the pond 140 to the nozzle outlet. Nozzle depth may play a role in the formation of large vortex rings and promote the entrainment of the co-flow into the jet flow.

Nozzle depth may play a role in determining nozzle spacing, or the distance between two nozzles. Nozzle spacing may be measured between outlets of two individual nozzles 230. The nozzles 230 in FIG. 2 are shown at substantially the same nozzle depth and approximately equally spaced from one another. The spacing between individual nozzles 230 may range from twenty to fifty centimeters. Nozzle spacing may be determined empirically and/or analytically based on the design of the pond 140 and other factors described more fully herein.

The nozzles 230 may include nozzles of any design that may be configured to issue a submerged jet. The designs of the individual nozzles 230 may play a role in properties associated with the resultant jet flow, e.g., vortex ring formation, flow velocities, entrainment, and turbulence intensity. For instance, the formation of vortex rings may be affected by the depth of each nozzle 230. The nozzles may therefore be viewed as individual units, which may be added, removed, and/or otherwise manipulated in real time in order to generate a desired resultant jet flow.

The nozzles 230 may be selected based on flow characteristics. For instance, a laminar boundary layer between fluid in the nozzles 230 and interior surfaces of the nozzles 230 (not shown in FIG. 2) from which a jet is issued may promote the formation of vortex rings in the algae cultivation pond fluid. Since the formation of vortex rings in the algae cultivation pond fluid may facilitate entrainment of the co-flow of the algae cultivation pond fluid into the jet flow, ranges of jet flow velocities may be maintained such that a laminar boundary layer is maintained in the nozzles 230. With respect to the embodiments discussed in FIGS. 1 and 2, the ranges of flow velocities may be empirically determined and programmable into a set of instructions that are executable by the control center 130.

In some embodiments, the manifold 220 may provide the pressurized algae cultivation pond fluid to the nozzles 230 via optional spouts 240. The spouts 240 may be useful when the manifold is placed above the pond 140 and the nozzles 230 are submerged in the algae cultivation pond fluid as shown in FIG. 2. A plurality of configurations of the manifold 220 beyond those shown in FIG. 2 may be implemented. For instance, the manifold 220 and the nozzles 230 may be submerged in the algae cultivation pond 140. In such embodiments, the manifold 220 may be placed parallel to the configuration shown in FIG. 2, but along the floor 142 of the algae cultivation pond, or buried in the floor 142 of the algae cultivation pond (placement not shown in FIG. 2). Alternatively, the manifold 220 may be placed along a wall 144 of the algae cultivation pond (placement not shown in FIG. 2). In addition, several manifolds 220 may be coupled to the pump 110 and placed at various depths in the algae cultivation pond.

Any number and/or type of gauges 250 and/or sensors may be used to measure various parameters in the jet array distribution system 120. For example, pressure sensors may be coupled to the manifold 220 to measure static pressure in the manifold 220. Flow meters may be used to measure flow rate in the manifold 220 to estimate the velocity of the jet at the outlet of any of the nozzles 230. The gauges 250 may be coupled to the control center 130, which may store and/or display data associated with the gauges 250. The gauges 250 may be coupled to the control center 130, which may execute algorithms to determine parameters such as flow rate, head loss, temperature, pH, concentrations of dissolved gases, turbidity, turbulence characteristics, and the like.

The jet array distribution system 120 may be used in conjunction with an algae cultivation pond of any design. The algae cultivation pond may include any body of water for the purpose of cultivating algae. For instance, the jet array distribution system 120 may be applied to open-air raceway ponds used in the cultivation of *Dunaliella* or *Spirulina*, flumes and/or algae channels.

The jet array distribution system 120 may be customized based on the design of the algae cultivation pond and/or the needs of the particular genus or species of algae being cultivated therein. For instance, the pond 140 may be characterized by a frictional head loss associated with a range of pond velocities. In order to promote circulation in the pond 140, the pump 110 may provide energy, or head, to the jets. As such, the nozzles 230 may be organized in an array such that the resulting jet array, and resultant jet flow from the jet array, overcomes the frictional head loss associated with the pond 140.

Jet flow properties may additionally be influenced by the interactions of individual jets downstream of the nozzles. As such, the nozzles 230 may be organized into arrays in order to achieve various objectives downstream of the nozzles. These objectives may include maximizing efficiency, minimizing jet entrainment distance, maximizing turbulence of the fluid flow in the algae cultivation pond, minimizing the effects of "dead zones," generating energetic vortices, and any combination of these. An exemplary linear nozzle array is shown in FIG. 2, with the four nozzles in approximately the same depth in the pond 140.

The nozzles 230 may be immobile and therefore form a static array. Alternatively, the array may be dynamic. For example, the nozzles 230 may be mobile and therefore various configurations of arrays may be arranged in real-time based on a desired resultant jet flow. In addition, the manifold 220 may be configured to provide pressurized algae cultivation pond fluid to all of the nozzles 230, or to selected nozzles 230 based on a desired jet and/or resultant jet flow. The arrangement of arrays may be managed at the control center 130. The control center 130 may execute instructions to manipulate and arrange various arrays based on a set of criteria, which may include, for example, a desired resultant jet flow, a desired ratio between a resultant jet flow and a background flow (co-flow) in the algae cultivation pond, and the like.

The number of jets forming the jet array may be affected by the design of the particular algae cultivation pond. For instance, the number may be determined based on one of a flow depth of the algae cultivation pond, a desired distance between two jets, a jet diameter (based on characteristics of a cross section of a nozzle from which the jet is issued), a co-flow velocity in the algae cultivation pond, a desired ratio between pond flow and jet flow, and any combination thereof. For instance, a distance of thirty centimeters between the nozzles 230 may be desired in order to maximize jet entrainment.

The orientation of the nozzles 230 with respect to the direction of circulation may play a role in forming a desired resultant jet flow. For instance, the array of nozzles 230 shown in FIG. 2 is substantially horizontal, with each nozzle substantially parallel to the direction of circulation, indicated by the arrow 270. As such, the horizontal may be characterized as the direction of bulk flow, or circulation, in the algae cultivation pond. The nozzles may be oriented toward the floor 142 of the pond 140 such that the angle of the nozzle, and therefore the angle of the issued jet, is negative with respect to the horizontal. Alternatively, the angle of the nozzle may be angled away from the floor 142 such that the angle of the issued jet is positive with respect to the horizontal.

Figure 3:
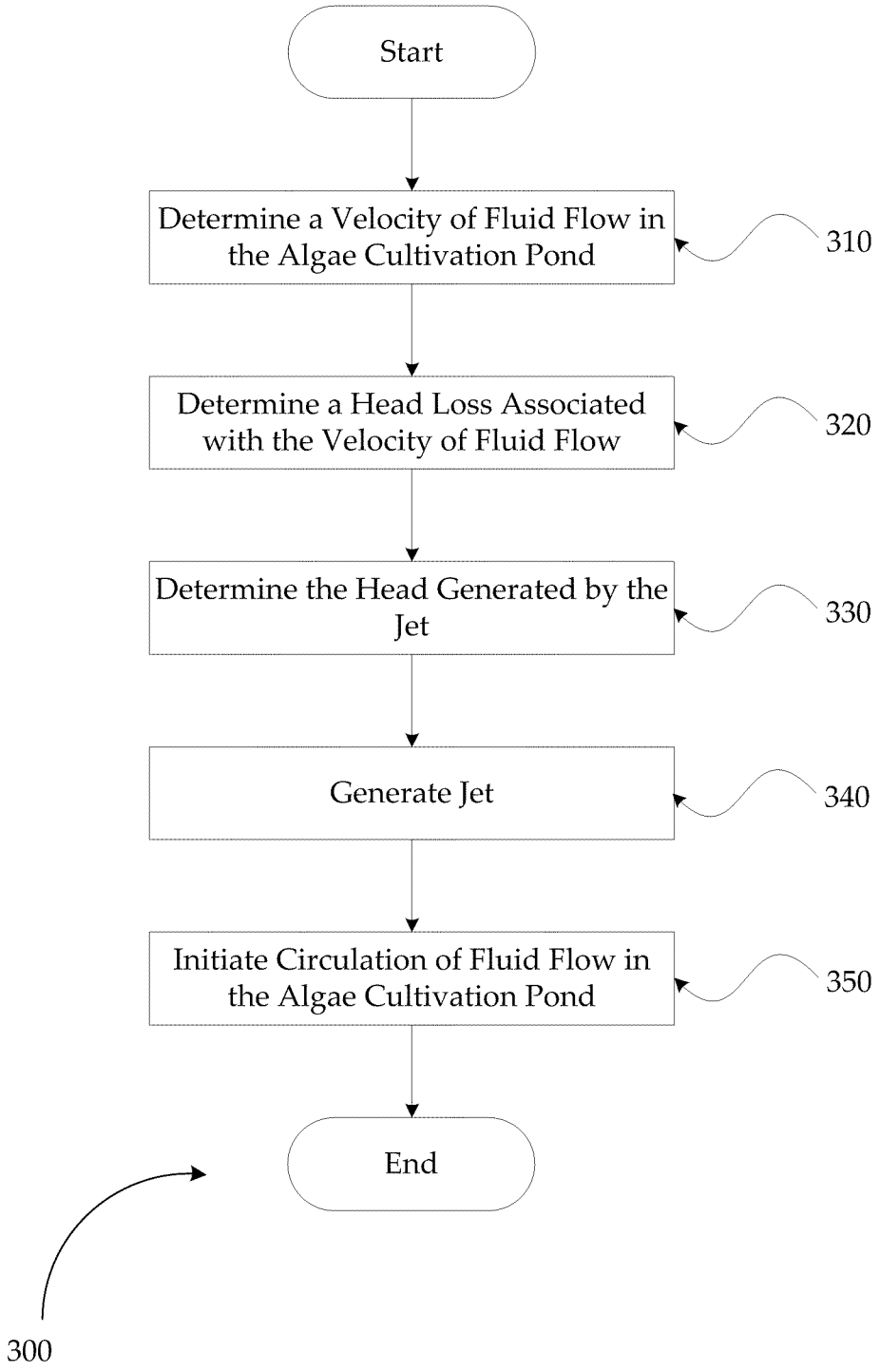
FIG. 3 illustrates a method for generating fluid flow in an algae cultivation pond in accordance with embodiments of the invention.

FIG. 3 illustrates a method 300 for generating fluid flow in an algae cultivation pond. In some embodiments, the method 300 may be used to generate flow of algae cultivation pond fluid in the pond 140 via the nozzles 230 and the control center 130, as discussed in the context of FIGS. 1 and 2. In step 310, a velocity for fluid flow in the algae cultivation pond is determined. The velocity for fluid flow in the algae cultivation pond may range from, for example, 10 cm/s to 100 cm/s. In order to reduce the effects of "dead zones" resulting from the jet flow, co-flow velocities of 40 cm/s to 70 cm/s in the proximity of the nozzle outlets may be effective.

In step 320, a head loss associated with the velocity of fluid flow in the algae cultivation pond determined in step 310. The head loss associated with the velocity of fluid flow may be determined based on the design of the algae cultivation pond and the determined velocity for fluid flow in step 310 may be taken into account. For instance, the head loss of the algae cultivation pond may be characterized as a loss of energy due to friction of fluid along the floor 142, any of the walls 144, as well as along turns and/or bends in the algae cultivation pond which may cause flow separation.

In step 330, the head generated by the jet is determined. The head generated by the jet in the pond may be selected so as to overcome the head loss determined in step 320 associated with the velocity for fluid flow determined in step 310. In step 340, a jet that overcomes the head loss determined in step 320 is generated. This may involve adjusting an energy provided by the pump 110 to the algae cultivation pond fluid as discussed in the context of FIG. 1. In step 350, circulation of fluid flow in the algae cultivation pond may be initiated. The submerged nozzles 230 may generate submerged jets from the pressurized fluid. The jets may simultaneously entrain a co-flow in the algae cultivation pond into the jet and generate circulation of algae cultivation pond fluid, e.g. pond flow.

Figure 4:
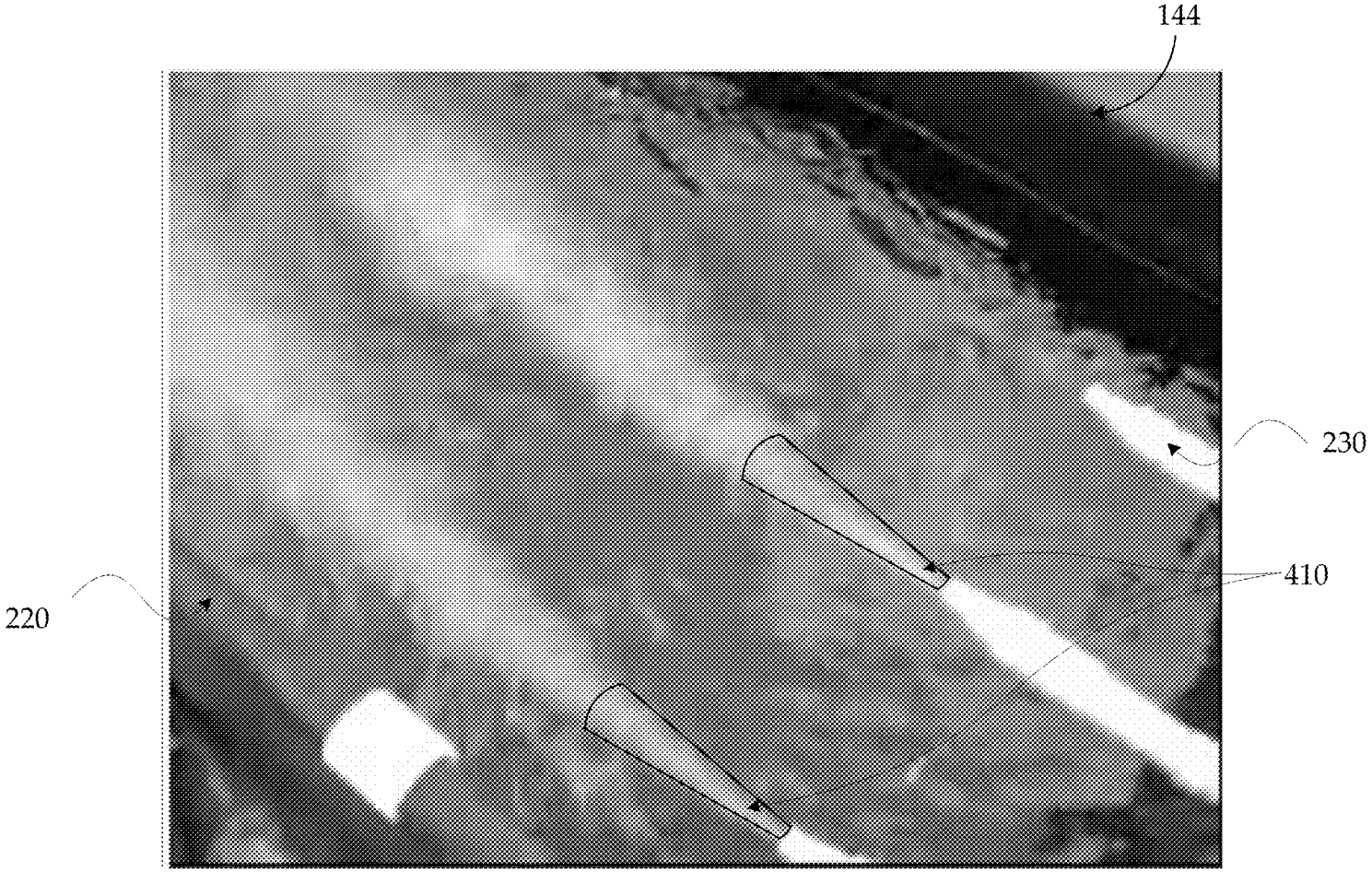
FIG. 4 is a photograph of jet entrainment of a co-flow in an algae cultivation pond in accordance with embodiments of the invention.

FIG. 4 is a photograph of jet entrainment of a co-flow in an algae cultivation pond in accordance with the embodiments discussed in the context of FIGS. 1, 2, and 3 above. FIG. 4 shows a wall 144 of a pond 140 (e.g. algae cultivation pond), a manifold 220, and three nozzles 230. The pond 140 is filled with algae cultivation pond fluid. FIG. 4 indicates that the nozzles 230 are fully submerged in the algae cultivation pond fluid. Jets 410 are issued from the nozzles 230. As is illustrated in FIG. 4, the jets 410 may entrain a co-flow in an algae cultivation pond, as is shown downstream of the jets 410. The entrainment of the co-flow into the jets as shown in FIG. 4 and the circulation in the pond resulting from the jets may correspond to step 350 in the method 300 discussed above.

In some embodiments, the efficiency of the jets 410 may be maximized in order to conserve energy output by a pressurized fluid source, such as the pump 110 described in the context of FIG. 1. The jet circulation system 100 may be implemented such that a fraction of the jet flow may initiate circulation of the co-flow of the algae cultivation pond fluid in the pond 140. In some embodiments, less than eight percent of the co-flow in a cross-section of the pond 140 may be provided to the jet.

Example

Figure 5:
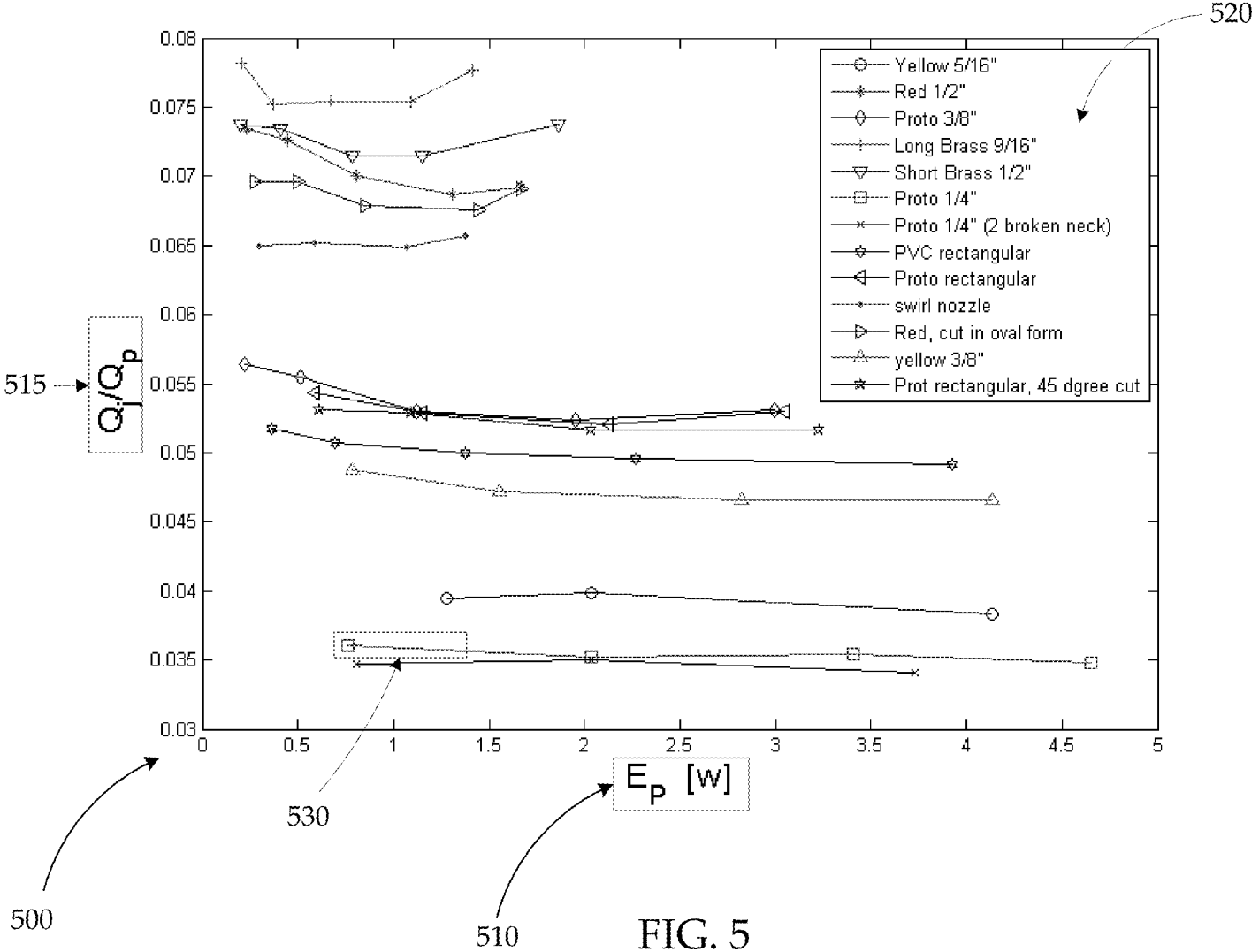
FIG. 5 illustrates experimental data from a jet circulation system in accordance with embodiments of the present invention.

FIG. 5 illustrates, via a chart 500, experimental data gathered by the inventors from a jet circulation system in accordance with the embodiments described in FIGS. 1, 2, 3 and 4 above. Nozzles of various designs were used in the course of the experiment, as shown in the legend 520. The x-axis 510 of chart 500 represents the energy loss of the pond per nozzle 230. The energy loss of the pond per nozzle may be directly proportional to the flow rate of the co-flow in the algae cultivation pond Qp. The y-axis 515 of chart 500 represents the ratio of the jet flow Qj to Qp. FIG. 5 illustrates that the jet circulation system may be used to circulate large quantities of fluid (e.g., Qp) with small quantities of fluid (e.g., Qj). For instance, curve 530, corresponds to the performance of the 'Proto ¼"' nozzle in the experiment. The substantially horizontal nature of the curve 530 indicates that for any flow rate in the algae cultivation pond Qp, the jet flow Qj may be as low as 3.5% of the Qp in order to promote circulation in algae cultivation pond fluid.

The above-described functions and/or methods may include instructions that are stored on storage media. The instructions can be retrieved and executed by a processor. Some examples of instructions are software, program code, and firmware. Some examples of storage media are memory devices, tape, disks, integrated circuits, and servers. The instructions are operational when executed by the processor to direct the processor to operate in accord with the invention. Those skilled in the art are familiar with instructions, processor(s), and storage media. Exemplary storage media in accordance with embodiments of the invention are discussed in the context of, for example, the control center 130 of FIG. 1. In addition, portions of the method 300 may be embodied in code that is executable by a computer associated with the control center 130.

Upon reading this paper, it will become apparent to one skilled in the art that various modifications may be made to the systems, methods, and media disclosed herein without departing from the scope of the disclosure. As such, this disclosure is not to be interpreted in a limiting sense but as a basis for support of the appended claims.

The invention claimed is:

1. A method for generating turbulent algae cultivation fluid flow in an open-air raceway algae cultivation pond, the method comprising:

initiating a circulation of fluid in the open-air raceway algae cultivation pond via at least one liquid jet, the circulation of fluid generating a velocity of the turbulent algae cultivation fluid flow of at least ten centimeters per second in the open-air raceway algae cultivation pond; and providing a head to the at least one liquid jet that overcomes a head loss associated with the velocity of the turbulent algae cultivation fluid flow of at least ten centimeters per second in the open-air raceway algae cultivation pond, wherein each liquid jet is connected to at least one submerged nozzle, the nozzle aligned parallel to the turbulent algae cultivation fluid flow, the nozzle increasingly constricting in diameter as it progresses from inflow to outflow, the nozzle positioned at or near a middle of the open-air raceway algae cultivation pond, and the liquid jet from the nozzle contributing to the fluid flow throughout a majority of the open-air raceway algae cultivation pond.

2. The method of claim 1, wherein initiating circulation of fluid in the algae cultivation pond includes generating a velocity of twenty centimeters per second in the algae cultivation pond.

3. The method of claim 1, wherein initiating circulation of fluid in the algae cultivation pond includes providing to the liquid jet less than eight percent of a flow in a cross-section of the algae cultivation pond.

4. The method of claim 1, wherein initiating circulation of fluid in the algae cultivation pond via at least one liquid jet includes generating two or more liquid jets.

5. The method of claim 4, wherein the two or more liquid jets form an array of liquid jets.

6. The method of claim 1, wherein a depth of the liquid jet from a surface of the algae cultivation pond is approximately in a middle of a flow depth of the algae cultivation pond.

7. The method of claim 6, wherein the depth of the liquid jet from the surface of the algae cultivation pond is between twenty and thirty centimeters.

8. The method of claim 1, further comprising:

measuring the velocity of the turbulent algae cultivation fluid flow in the algae cultivation pond; and adjusting the head generated by the liquid jet.

9. The method of claim 1, wherein the nozzle from which the liquid jet is issued includes a laminar boundary layer.

10. The method of claim 1, further comprising initiating an entrainment of a flow in the algae cultivation pond into the liquid jet.

11. The method of claim 10, wherein initiating an entrainment of a flow in the algae cultivation pond is via a plurality of vortices.

12. The method of claim 1, wherein the head generated by the liquid jet initiates circulation of a turbulent co-flow in the algae cultivation pond.

13. The method of claim 12, further comprising maximizing an efficiency of the liquid jet based on a jet flow and the turbulent co-flow in the algae cultivation pond.

14. A system for generating turbulent algae cultivation fluid flow via a jet in an open-air raceway algae cultivation pond, the system comprising:

at least two submerged liquid jets configured to initiate circulation of fluid in an open-air raceway algae cultivation pond, such that a head generated by the at least two liquid jets overcomes a head loss of the open-air raceway algae cultivation pond when a velocity of the turbulent algae cultivation fluid flow in the open-air raceway algae cultivation pond is at least ten centimeters per second, wherein each liquid jet is connected to at least one submerged nozzle, the at least one submerged nozzle aligned parallel to the turbulent algae cultivation fluid flow, the at least one submerged nozzle increasingly constricting in diameter as it progresses from inflow to outflow, the at least one submerged nozzle positioned at or near a middle of the open-air raceway algae cultivation pond, and the liquid jet from the nozzle contributing to the fluid flow throughout a majority of the open-air raceway algae cultivation pond.

15. The system of claim 14, wherein the at least two liquid jets form an array of liquid jets.

16. The system of claim 15, wherein a number of liquid jets forming the array of jets is determined based on one of flow depth of the algae cultivation pond, a desired distance between two liquid jets of the array of liquid jets, a cross section of a nozzle outlet associated with a liquid jet of the array of liquid jets, a velocity of a turbulent flow in the algae cultivation pond, and any combination thereof.

17. A system for generating turbulent algae cultivation fluid flow via a liquid jet in an open-air raceway algae cultivation pond, the system comprising:

a series of nozzles submerged below a surface of an open-air raceway algae cultivation pond, the series of nozzles coupled to a pressurized fluid source;

a processor; and a computer-readable storage medium having embodied thereon a program executable by the processor to generate turbulent algae cultivation fluid flow in the open-air raceway algae cultivation pond, wherein the computer-readable storage medium is coupled to the processor and the pressurized fluid source, the processor executing instructions on the computer-readable storage medium to:

measure a velocity of turbulent algae cultivation fluid flow in the open-air raceway algae cultivation pond, and adjust an energy generated by the pressurized fluid source, the series of nozzles increasingly constricting in diameter as each nozzle progresses from inflow to outflow, the series of nozzles positioned at or near a middle of the open-air raceway algae cultivation pond, and the liquid jet from the nozzle contributing to the fluid flow throughout a majority of the open-air raceway algae cultivation pond.

18. The system of claim 17, wherein the program executed by the processor further comprises:

initiating a circulation of fluid in the open-air raceway algae cultivation pond via at least one liquid jet, the circulation of fluid generating a velocity of turbulent algae cultivation fluid flow of at least ten centimeters per second in the open-air raceway algae cultivation pond; and providing a head to the liquid jet that overcomes a head loss associated with the velocity of the turbulent algae cultivation fluid flow of at least ten centimeters per second in the open-air raceway algae cultivation pond.

19. The system of claim 17, wherein a distance between two adjacent nozzles of the series of nozzles is approximately thirty centimeters.

* * * * *